United States Patent [19]

Love

[11] 4,251,932

[45] Feb. 24, 1981

[54] FOOT CUSHIONING DEVICE

[76] Inventor: Flossie M. Love, 8022 S. Harper Ave., Chicago, Ill. 60619

[21] Appl. No.: 55,079

[22] Filed: Jul. 5, 1979

[51] Int. Cl.[3] ..... A43B 1/10; A43B 3/18; A43B 13/12

[52] U.S. Cl. ..... 36/7.4; 36/30 R; 36/28; 36/7.7

[58] Field of Search ..... 36/110, 28, 30 R, 30 A, 36/7.2, 7.3, 7.4, 102, 103, 104, 11, 11.5, 9, 7.7, 71

[56] References Cited

U.S. PATENT DOCUMENTS

| | | | |
|---|---|---|---|
| 1,810,514 | 6/1931 | Bennett | 36/7.4 |
| 2,502,774 | 4/1950 | Alianiello | 36/28 |
| 3,027,658 | 4/1962 | Rigsby | 36/112 |
| 3,057,085 | 10/1962 | Rigsby | 36/112 |
| 3,699,672 | 10/1972 | Sims | 36/7.7 |
| 3,914,882 | 10/1975 | Greer | 36/7.7 |
| 4,069,601 | 1/1978 | Robbins et al. | 36/30 R |

*Primary Examiner*—Patrick D. Lawson
*Attorney, Agent, or Firm*—Bacon & Thomas

[57] ABSTRACT

A first sheet of rubber adapted to be put under a shoe and secured in place over the top of the shoe has a sole portion made up of the first sheet of rubber, a layer of foam rubber and an inner layer of sheet rubber sewn to the first sheet to enclose the foam rubber. The device provides cushioning comfort for the feet of the wearer while standing, walking or running on hard surfaces.

3 Claims, 6 Drawing Figures

FOOT CUSHIONING DEVICE

BACKGROUND OF THE INVENTION

This invention is in the field of shoe covering cushioning devices for the purpose of providing comfort to the wearer.

Considerable discomfort can be experienced by persons standing, walking or running on hard surfaces for extended periods of time. The experience is not only capable of producing extreme discomfort, but can also result in extreme fatigue, shin splints or similar afflictions.

It has already been proposed to provide shoe covering devices for various purposes, none of which known to applicant, however, are for the purpose of providing comfort. See, for example, the patent to Bradley, U.S. Pat. No. 70,157, which shows a device to be tied over a shoe to provide gripping devices for preventing slipping on ice. The patent to McKinnley, U.S. Pat. No. 1,663,381, discloses a device to be tied over a shoe to protect the shoe from damage. The patent to Whitley, U.S. Pat. No. 2,246,562, likewise shows a device to be laced over a shoe to provide the proper surface under the sole for bowling. However, none of the above patents suggest or disclose cushioning material to provide comfort to the wearer. Each of their devices includes a lower surface comprising a single layer or sheet of material.

The British patent to Neumark, U.K. Pat. No. 1,156,907, shows a device in the nature of an overshoe for use by parachutists and provides a thick slab of foam rubber or plastic material under the shoe sole and heel for the purpose of absorbing shocks upon landing. However, the cushioning material is a single layer and would be inappropriate for use in the manner contemplated for the present invention.

SUMMARY OF THE INVENTION

The present invention comprises principally a sheet of rubber or rubber-like material adapted to be wrapped under and over the forward part of a shoe and the sole portion of which is in the form of a laminated structure with the sheet of rubber material constituting the outer layer, an inner layer of similar rubber material defines a pocket between itself and the outer sheet and a layer of foam rubber or the like is held in that pocket and underlies the wearer's foot. The device may be worn while standing or walking or running in hard surfaces and provides comfort and prevents the development of shin splints and similar results. In one form of the invention, the device is of a size to underlie only the forward or ball portion of the foot with the cushioning material underlying only the forward half of the shoe. In a second form, the device provides cushioning under the entire foot from toe to heel and further includes a rear tab to be folded upwardly and tied or otherwise secured to the device to hold the cushion device in place.

DESCRIPTION OF THE PREFERRED EMBODIMENT

Figure 1:
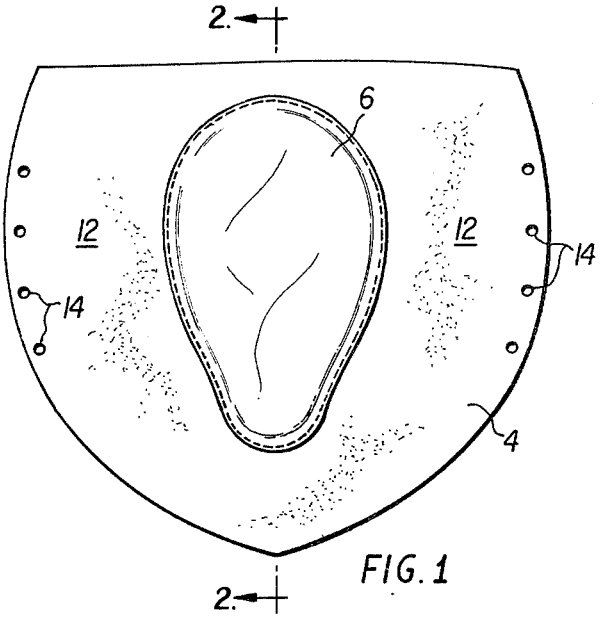
FIG. 1 is a plan view of the device of the present invention shown in spread-out condition.
Figure 3:
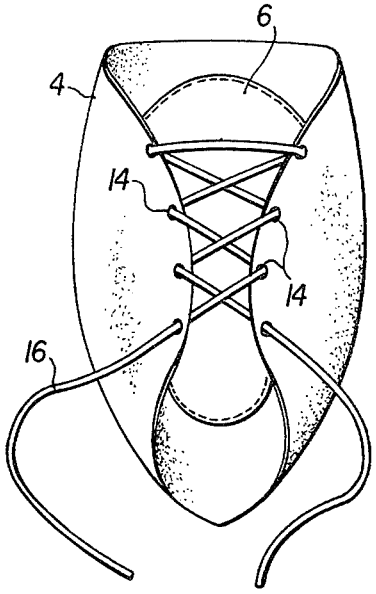
FIG. 3 is a top plan view similar to FIG. 1 but showing the device folded upwardly and showing lacing to hold the device in its applied position.
Figure 2:
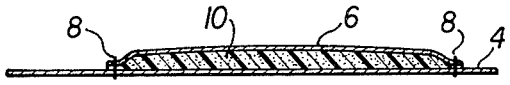
FIG. 2 is a vertical sectional view taken generally along line 2—2 of FIG. 1.

In FIGS. 1 through 4, numeral 4 designates a sheet of rubber or rubber-like material constituting the main body portion of applicant's invention. A central portion of the sheet 4 is covered by a second sheet of similar material designated at 6 and which is sewn to the sheet 4 around the periphery of the portion 6. Preferably the sheet 6 is configured to the same outline as the sole portion of a shoe to which it is to be applied, but is adapted to cover only that portion of the shoe that normally contacts the ground forwardly of the heel. As shown in FIG. 2, the inner sheet 6 is sewn as at 8 about its periphery to an intermediate portion of the sheet 4 and defines a pocket with the sheet 4 which pocket contains a layer of foam rubber 10 or similar cushioning material. Side portions 12 of the sheet 4 extend outwardly beyond the inner sole portion 6, and at their outer edges, the side portions are provided with openings 14 adapted to receive laces 16 for holding the side portions folded upwardly and over the top of a shoe to which the device is applied.

Figure 4:
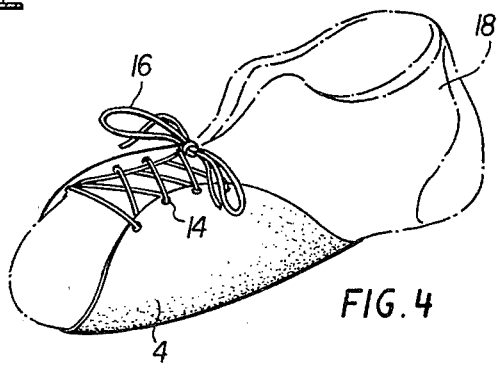
FIG. 4 is a perspective view of a shoe having the device of the present invention applied thereto.

FIG. 4 shows the device applied to a shoe 18 and it is to be assumed that the shoe is being worn by a person. It will be apparent that the sole portion comprising the inner region of sheet 4, cushioning material 10 and inner lamination 6 defines a cushion under the foot of the wearer providing the comfort referred to previously.

Figure 5:
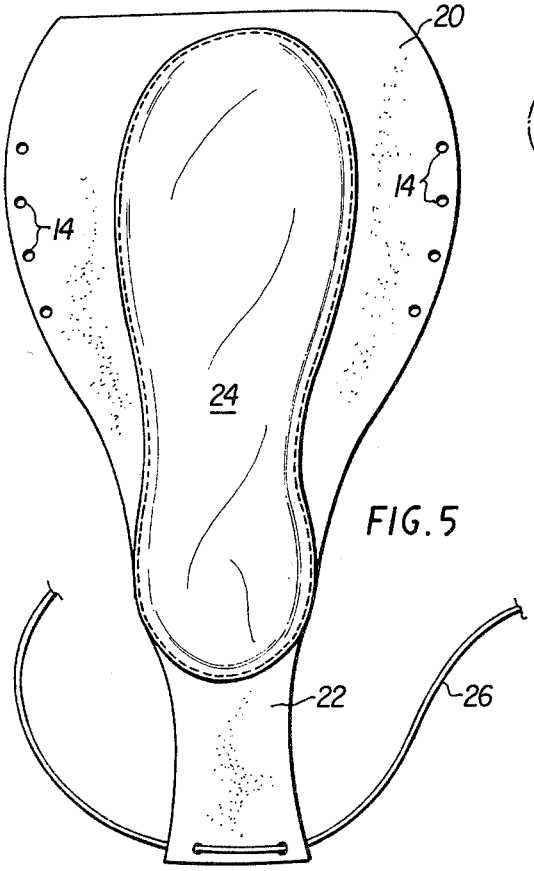
FIG. 5 is a plan view of a second embodiment of the device, which is adapted to cover the entire bottom of the shoe including not only the ball portion but the heel.

FIG. 5 illustrates a second embodiment of the invention wherein a base or outer sheet 20 of rubber or rubber-like material is configured to underlie the entire shoe and to have a rearwardly extending portion 22 extending rearwardly beyond the central cushioning laminar structure designated at 24. The laminar structure 24 is contemplated to be essentially the same as that shown in FIG. 2 wherein the sheet 20 constitutes an outer layer and an inner sheet of the shape shown and which underlies the entire shoe constitutes an inner layer with cushioning material 10 between the layers extending completely from the toe to the heel of the device. The side portions of the sheet 20, at least in the forward region, are also provided with openings 14 for receiving laces or the like and the extending portion 22 is provided with a string or cord 26 to assist in holding the device on the shoe of the wearer in the manner shown in FIG. 6. As shown in that Figure, the forward side portions of the sheet 20 is folded upwardly around the sides of the shoe 18 and are laced together across the top of the shoe. As shown, the lace 26 is continuous from the extending portion 22, and is laced through the openings 14 to provide securement of the device to the shoe of the wearer.

Figure 6:
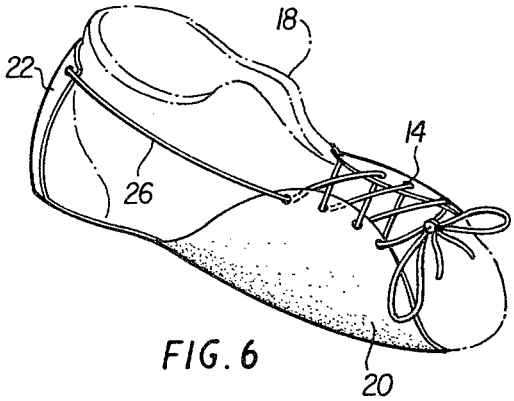
FIG. 6 is a perspective view showing application of the device of FIG. 5 to a shoe.

It will be apparent from the foregoing description that the device described, when worn, provides a soft and cushioned surface for the foot of the wearer by absorbing the impact that results from the foot striking or pounding a non-resiient supporting surface or floor. The shock imparted to the feet, ankles, shins, knees and hips is thereby greatly reduced. The device is not intended to be worn as a shoe, nor is it to be used in competition. It can be used as a training device and is worn over the shoe on surfaces such as certain tracks, streets, side walks, gymnasium floors, tiled floors and concrete floors. For use when the wearer moves about considerably, it is preferred that the device shown in FIGS. 1 to 4 be worn since that modification cushions heel impacts also. However, if the wearer intends to stand for long periods of time on a hard surface in generally a limited area, the modification shown in FIGS. 5 and 6 is preferred.

While the description herein shows lacing for holding the device to the shoe of the wearer, it is contemplated and in many instances will be preferred that the lacing be replaced by a readily releasable fastening known in the trade as "Velcro". It is not believed necessary to illustrate the manner of applying Velcro to the device, since such would be perfectly obvious to those skilled in the art.

While a limited number of specific embodiments of the invention have been shown and described herein, the same are merely illustrative of the principles of the invention and other forms may be employed within the scope of the appended claims.

What I claim is:

1. A cushioning device to be applied over footwear, comprising:

a first sheet of sheet rubber material of a size and configuration to cover at least the sole portion of a shoe and having side portions adapted to be joined over at least side portions of the shoe;

that portion of said device arranged to underlie the sole of the shoe being of laminar construction wherein said first sheet of rubber material constituting an outer layer, an inner layer of compressed sheet rubber material over the central portion of said outer layer and secured at its edges to said first sheet to define a pocket therebetween, and a layer of foam rubber in said pocket.

2. A cushioning device as defined in claim 1 wherein said portion of laminar construction is configured to underlie the entire shoe, including the sole portion and the heel portion;

said first sheet extending rearwardly from said laminar portion to be folded upwardly over the rear portion of the shoe; and means for securing said rearwardly extending portion in its upwardly folded position.

3. A cushioning device as defined in claim 2 wherein said last-named means comprises a flexible filament extending from opposite sides of said rearwardly extending portion and adapted to be secured to said side portions.

* * * * *